US007397432B2

(12) United States Patent
Ku et al.

(10) Patent No.: US 7,397,432 B2
(45) Date of Patent: Jul. 8, 2008

(54) BUILT-IN ANTENNA MODULE FOR PORTABLE WIRELESS TERMINAL

(75) Inventors: Do-Il Ku, Suwon-si (KR); Chin-Sop Choe, Sungnam-si (KR)

(73) Assignee: Samsung Electronics Co., Ltd. (KR)

( * ) Notice: Subject to any disclaimer, the term of this patent is extended or adjusted under 35 U.S.C. 154(b) by 184 days.

(21) Appl. No.: 11/227,885

(22) Filed: Sep. 15, 2005

(65) Prior Publication Data

US 2006/0066490 A1 Mar. 30, 2006

(30) Foreign Application Priority Data

Sep. 17, 2004 (KR) ..... 10-2004-0074748

(51) Int. Cl.
*H01Q 1/24* (2006.01)

(52) U.S. Cl. ..... 343/702; 343/700 MS

(58) Field of Classification Search ..... 343/700 MS, 343/846, 848, 702
See application file for complete search history.

(56) References Cited

U.S. PATENT DOCUMENTS 4,051,477 A * 9/1977 Murphy et al. ..... 343/700 MS
2003/0151555 A1* 8/2003 Holshouser ..... 343/700 MS
2004/0160367 A1* 8/2004 Mendolia et al. ..... 343/700 MS
2005/0140554 A1* 6/2005 Wang et al. ..... 343/702

FOREIGN PATENT DOCUMENTS

| | | |
|---|---|---|
| EP | 1 209 760 | 5/2002 |
| EP | 1 286 413 | 2/2003 |
| EP | 1 441 412 | 7/2004 |
| WO | WO 2004/025776 | 3/2004 |

* cited by examiner

*Primary Examiner*—HoangAnh T Le
(74) *Attorney, Agent, or Firm*—The Farrell Law Firm, PC

(57) ABSTRACT

A built-in antenna module for a portable wireless terminal is provided. In the built-in antenna module, a mainboard, which is an RF board, has a feeding unit and a grounding unit. A radiator is disposed on one side of the mainboard and has a feed pin and a ground pin that are electrically connected to the feeding unit and the grounding unit, respectively. A conductive ground plate is disposed on the other side of the mainboard to have a predetermined height. An end of the conductive ground plate is grounded to the grounding unit of the mainboard. The distance between the radiator and the ground plate is maximized to improve antenna performance.

7 Claims, 6 Drawing Sheets

PRIOR ART

PRIOR ART

BUILT-IN ANTENNA MODULE FOR PORTABLE WIRELESS TERMINAL

PRIORITY

This application claims priority under 35 U.S.C. § 119 to an application entitled "Built-In Antenna Module For Portable Wireless Terminal" filed in the Korean Intellectual Property Office on Sep. 17, 2004 and assigned Ser. No. 2004-0074748, the contents of which are incorporated herein by reference.

BACKGROUND OF THE INVENTION

1. Field of the Invention

The present invention relates to an antenna module built in a portable wireless terminal, and more particularly, to a built-in antenna module for improving performance of a variety of antennas, such as improving a radiation characteristic of a Planar Inverted-F Antenna (PIFA) and reducing a Specific Absorption Rate (SAR).

2. Background of the Prior Art

Recently, mobile wireless terminals, such as PCS, DCS, GPS, PDA, cellular phones and wireless notebooks, are growing in popularity; and terminals with various functions and designs are being introduced. Further, small-sized, slim and lightweight terminals are being introduced, and users expect such terminals to also support such various functions. Therefore, the design of the terminal is focused on reducing terminal size while maintaining or improving the functions, for customer satisfaction.

Specifically, a rod antenna (or whip antenna) or a helical antenna that is protruded outward from the terminal is easy to break when the terminal is dropped, and such antennas reduce the portability of the terminal. Therefore, a plate type antenna installed within the terminal is widely used in recent days (also called a built-in antenna, internal antenna, or intenna) and various efforts are made to improve the performance and productivity of the built-in antenna.

Generally, the above-described built-in antenna is electrically connected to a mainboard (RF board) of a terminal body. At this time, the built-in antenna has two feeding lines. One line is electrically connected to a feeding unit of the mainboard, and the other line is grounded to a conductive ground layer of a multi-layered mainboard for operation. At this time, the ground layer is positioned at an uppermost layer of the mainboard, and the plate type built-in antenna (radiator) is grounded with only a grounding unit. The feeding unit is lead-out downwardly to a distance of a predetermined height from the mainboard by use of a fixing bracket. Generally, a Planar Inverted F Antenna (PIFA, a plate type built-in antenna) has improved performance when the size of a radiator, the area of a ground surface and the height between the radiator and the ground surface are increased.

However, a conventional feeding structure of the built-in antenna has a drawback in that a larger distance between the PIFA and the ground surface of the mainboard goes against consumer's desire for slimness of the portable terminal and simplification. Accordingly, recent slide type terminals being put on a market, have deteriorated antenna performance.

SUMMARY OF THE INVENTION

Accordingly, the present invention is directed to a built-in antenna module for a portable wireless terminal, which substantially obviates one or more problems due to limitations and disadvantages of the related art.

An object of the present invention is to provide a built-in antenna module for a portable wireless terminal in which maximum use is made of a void space of the terminal to reduce the total bulk of the terminal and, at the same time, to improve antenna performance.

Another object of the present invention is to provide a built-in antenna module for a portable wireless terminal in which a void space of the terminal is utilized while a separation distance between a radiator and a ground surface of a mainboard is increased to the maximum to improve antenna performance.

A further object of the present invention is to provide a built-in antenna module for a portable wireless terminal in which a separate grounding unit grounded to a radiator is provided to operate together with a ground surface of a mainboard, thereby improving a radiation characteristic and reducing a Specific Absorption Rate (SAR).

A still further object of the present invention is to provide a PIFA type built-in antenna module for a portable wireless terminal in which a radiator and a ground surface of a mainboard are spaced apart from each other at a maximum distance without increasing the terminal bulk, to improve antenna performance.

To achieve the object and other advantages, according to one aspect of the present invention, there is provided a built-in antenna module for a portable wireless terminal, the module including a mainboard being a RF board and having a feeding unit and a grounding unit; a radiator disposed on one side of the mainboard, and having a feed pin and a ground pin electrically connected to the feeding unit and the grounding unit, respectively; and a conductive ground plate disposed on the other side of the mainboard to have a predetermined height, an end of the conductive ground plate being grounded to the grounding unit of the mainboard, wherein the radiator and the ground plate are spaced at a maximum distance from each other to improve antenna performance.

According to the present invention, in order to provide maximum separation of the radiator from the feed surface, the conductive layer, which is most distant from the radiator, of the multi-layered mainboard being a Printed Circuit Board (PCB) is provided to electrically connect with the grounding unit of the radiator.

More preferably, in addition to the conductive layer of the mainboard, a separate conductive ground plate is disposed on the mainboard and used as ground means. In other words, it is desirable that the ground plate is disposed on the surface of the mainboard and the radiator is disposed on the opposite surface of the mainboard. Accordingly, the radiator and the ground surface are further spaced apart from each other by a thickness of the mainboard and a height of the disposed ground plate, thereby improving antenna performance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. A detailed description of well known features will be omitted for clarity of description.

The present invention illustrates and describes a slide type terminal, but is not so limited. For example, the present invention is applicable to a variety of wireless devices such as PDAs, general terminals, and wireless notebook personal computers that employ a plate type built-in antenna module.

Figure 1:
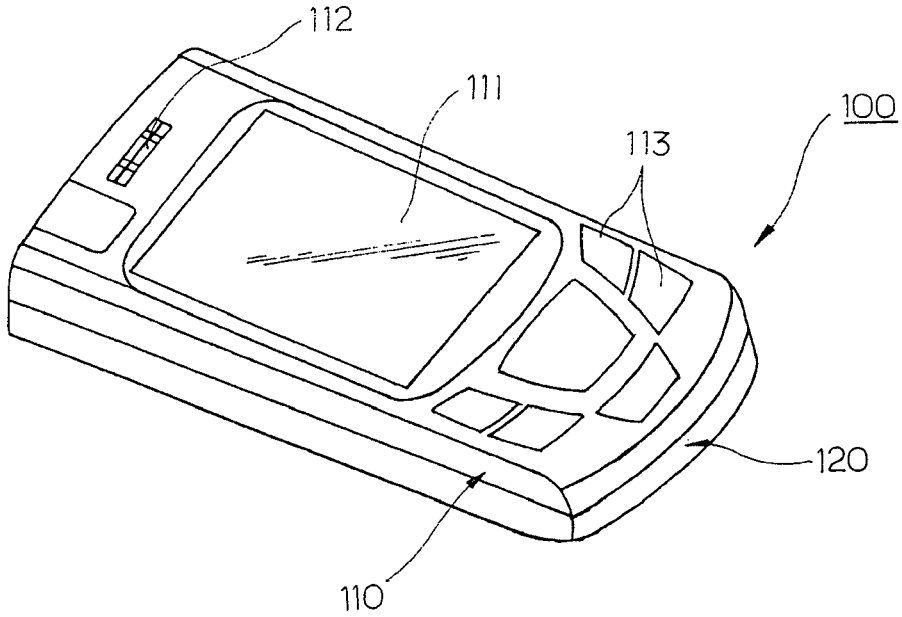
FIG. 1 is a perspective view illustrating a conventional slide type portable wireless terminal.
Figure 2:
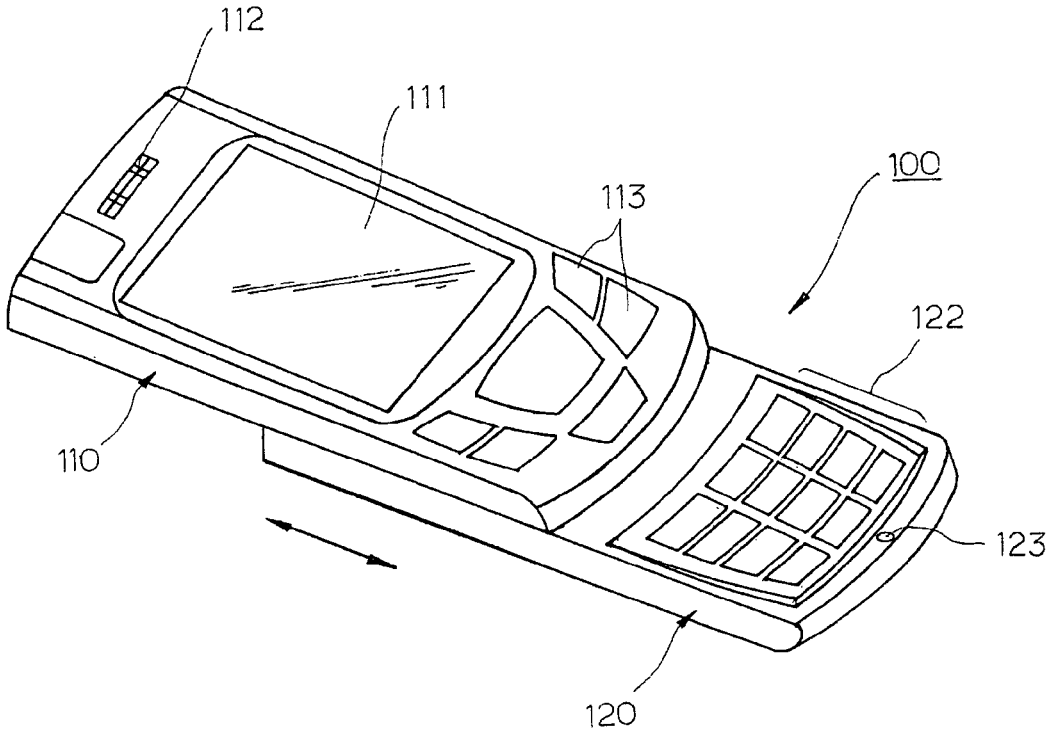
FIG. 2 is a perspective view illustrating a slide-up state of a conventional slide type portable wireless terminal.

FIG. 1 is a perspective view illustrating a conventional slide type portable wireless terminal, and FIG. 2 is a perspective view illustrating a slide-up state of a conventional slide type portable wireless terminal.

As shown in FIGS. 1 and 2, the slide type portable wireless terminal 100 includes a main body 120; and a slide body 110 slidable on the main body 120 by a predetermined distance in a lengthwise direction of the terminal. The slide body 110 is installed on the main body 120. As shown in FIG. 1, the portable wireless terminal 100 can be carried with the slide body 110 and the main body 120 fully overlapping each other. As shown in FIG. 2, the portable wireless terminal 100 can perform a communication operation and the like in a state where the slide body 110 is slid up and protruded from the main body 120 by the predetermined distance. Those of skill in the art will recognize that the antenna of the present invention is not so limited, and the portable wireless terminal 100 can also operate in the overlapped arrangement shown in FIG. 1.

A displaying unit 111 is disposed at a front surface of the slide body 110. The displaying unit 111 can be a color, wide LCD module, and is preferably a touch screen panel. A speakerphone unit 112 can be disposed at an upper side of the displaying unit 111 to receive voice from the other party. At least one keypad assembly 113 is disposed at a lower side of the displaying unit 111. Preferably, the keypad assembly 113 can include navigation key buttons.

Another keypad assembly 122 includes a plurality of key buttons, preferably, numeric key buttons (3×4 key buttons). The keypad assembly 122 can be disposed at the main body 120, which is shown when the slide body 110 is slid up on the main body 110. A microphone unit 123 is disposed at a lower side of the keypad assembly 122 to transmit a user's voice to the other party.

Figure 3:
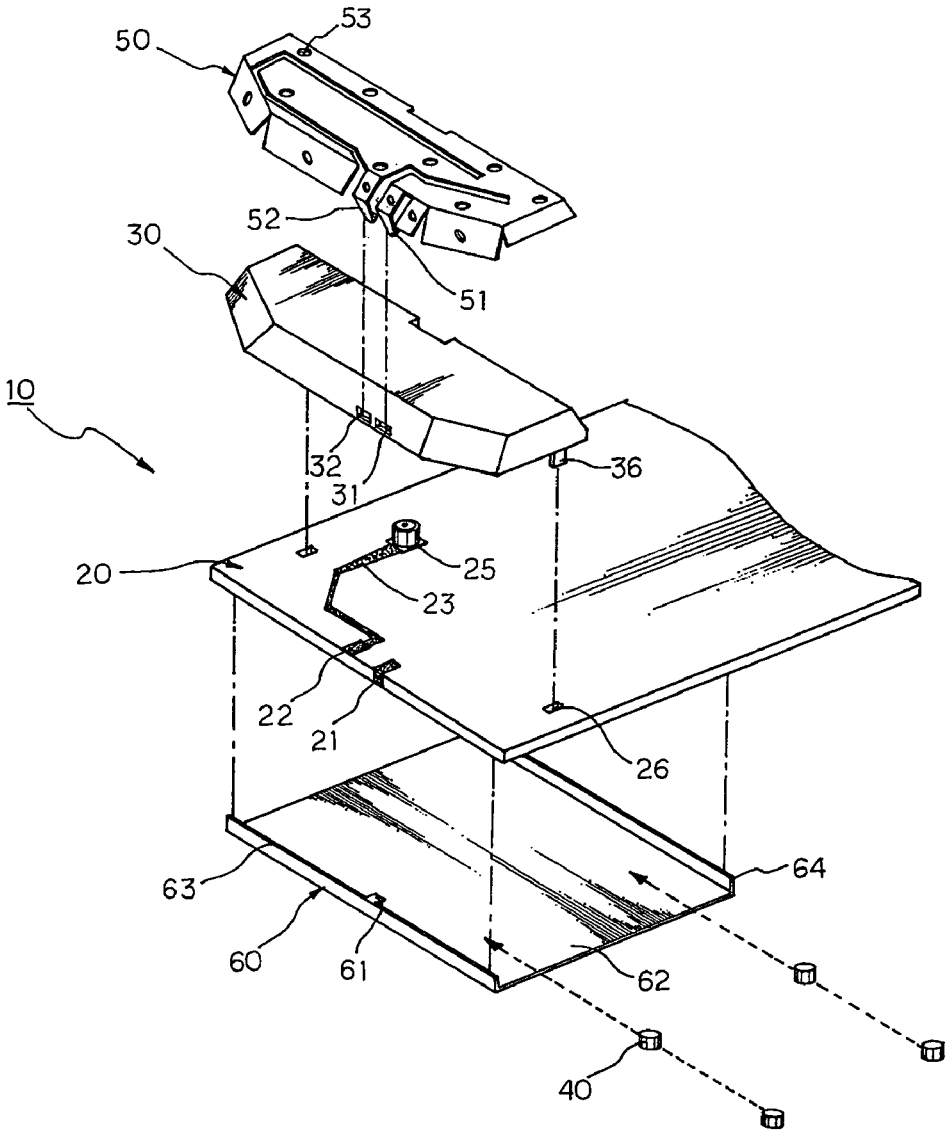
FIG. 3 is a disassembled perspective view illustrating a built-in antenna module according to the present invention.

FIG. 3 is a disassembled perspective view illustrating a built-in antenna module 10 according to the present invention. The built-in antenna module includes a mainboard 20; a radiator 50 disposed on the mainboard 20; and a ground plate 60 having a predetermined size and disposed on a rear surface of the mainboard 20. A grounding unit 21 and a feeding unit 22 are disposed on the mainboard 20 to be electrically and respectively connected to a ground pin 51 and a feed pin 52, which are lead-out from the radiator 50. The feeding unit 22 is electrically connected with a RF connector 25 through a pattern 23 formed on the mainboard 20.

The radiator 50 can be disposed on and fixed to a radiator fixing bracket 30. The bracket 30 can be formed of a synthetic resin, and the radiator 50 is a thin metallic plate. Accordingly, there is a drawback in that in case where the radiator 50 is separately fixed to the mainboard, the radiator 50 can readily later warp in shape, thereby changing a radiation characteristic of an antenna and degrading performance. The radiator 50 has a plurality of openings 53 for allowing the radiator 50 to be fixed to the fixing bracket 30 by using a supersonic fusion and the like. The bracket 30 can have through-holes 31 and 32. The through-holes 31 and 32 allow the ground pin 51 and the feed pin 52 to respectively pass through and connect to the grounding unit 21 and the feeding unit 22 of the mainboard. Further, a fixing protrusion 36 is downwardly extended and protruded from both side surfaces of the bracket 30 to be inserted into a fixing groove 26, thereby firmly fixing the bracket 30 to the mainboard 20.

The ground plate 60 is disposed at a lower side of the mainboard 20 to be distant by a predetermined distance from the mainboard 20. Preferably, the ground plate 60 has bent portions 63 and 64, which are bent to have a predetermined height at left and right ends of a planar portion 62, to maintain the separation distance from the mainboard 20. A predetermined ground tab 61 is disposed to protrude from one end of the ground plate 60 and electrically connect to the grounding unit 21 of the mainboard 20. Though not illustrated, a plurality of screws are used to couple the ground plate 60 to the mainboard 20, or a solder or nonconductive adhesive means is used to attach the ground plate 60 to the mainboard 20. At this time, if the ground plate 60 is attached to the mainboard 20, the ground tab 61 of the ground plate 60 is electrically connected with the grounding unit 21 of the mainboard 20. Accordingly, the ground pin 51 of the radiator 50 is electrically connected with the grounding unit 21 of the mainboard 20 and at the same time, also electrically connected with the ground tab 61 of the ground plate 60.

Figure 4:
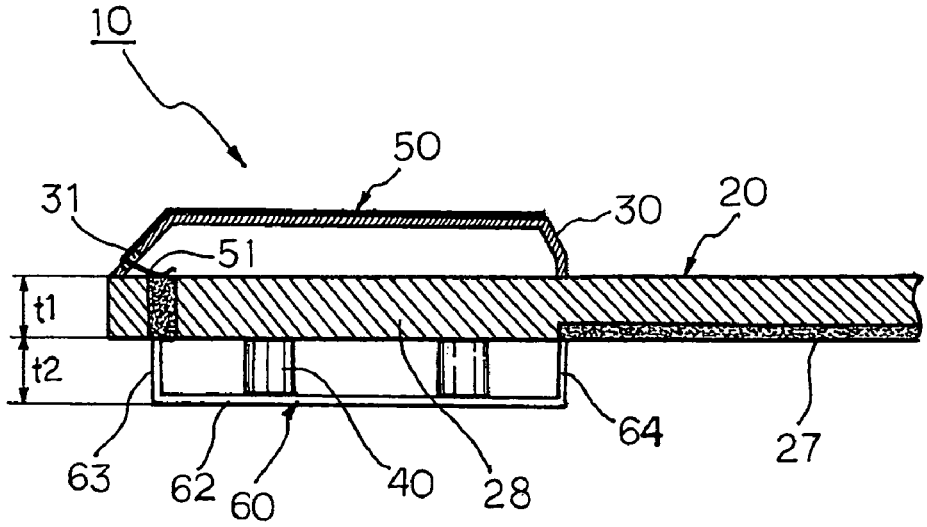
FIG. 4 is an enlarged sectional view illustrating main parts of a built-in antenna module according to the present invention.

FIG. 4 is an enlarged sectional view illustrating main parts of the built-in antenna module according to the present invention.

According to the present invention, the separate ground plate 60 is disposed at the lower surface of the mainboard 20 so as to increase the separation distance between the radiator 50 and the ground surface. Accordingly, the present invention has a ground structure in which the radiator 50 is grounded to the ground plate 60 through the ground pin 51. Further, according to the present invention, the radiator 50 is also grounded through the ground pin 51 to a conductive layer 27 of the mainboard 20, which corresponds to a conventional printed circuit board. More particularly, the ground plate 60 to which the ground pin 51 is grounded is electrically connected to the conductive layer 27 of the mainboard 20.

At this time, the conductive layer 27 is not formed on a portion 28, at which the ground plate 60 is disposed, of the mainboard 20 because when the portable wireless terminal is in use, a foreign or conductive material is introduced between the ground plate 60 and a conductive layer formed on the portion 28 to ground the ground plate 60 to the conductive layer 27 of the portion 28, thereby reducing the separation distance between the radiator 50 and the ground plate 60. Therefore, the portion 28 of the mainboard 20, at which the ground plate 60 is disposed, is formed using only a dielectric material.

Accordingly, as shown in FIG. 4, the radiator 50 has a structure in which the ground plate 60 and the conductive layer 27 are grounded through the grounding unit 21 of the mainboard 20. The conductive layer 27 is formed on a portion at which the ground plate 60 of the mainboard 20 is not disposed. More preferably, the conductive layer 27 is disposed to be most distant from the radiator 50. Further, a plurality of spacers 40 are interposed between the ground plate 60 and the mainboard 20 so that warping of the ground plate 60 is prevented, thereby narrowing the separation distance between the ground plate 60 and the radiator 50. At this time, the spacer 40 is preferably formed of a nonconductive material, for example, a synthetic resin.

As shown in FIG. 4, the above-described construction allows the distance between the radiator and the conductive surface to increase by a sum thickness of t1 (thickness of mainboard) and t2 (height of ground plate (60)) to contribute to the improvement of the antenna performance.

Alternatively, for convenience of installation, the grounding unit 21 is disposed on the mainboard 20, and the ground pin 51 is electrically connected to an upper portion of the grounding unit 21, and the ground tab 61 is electrically connected to a lower portion of the grounding unit 21. However, the ground pin 51 may be directly connected to the ground tab 61.

Figure 5A:
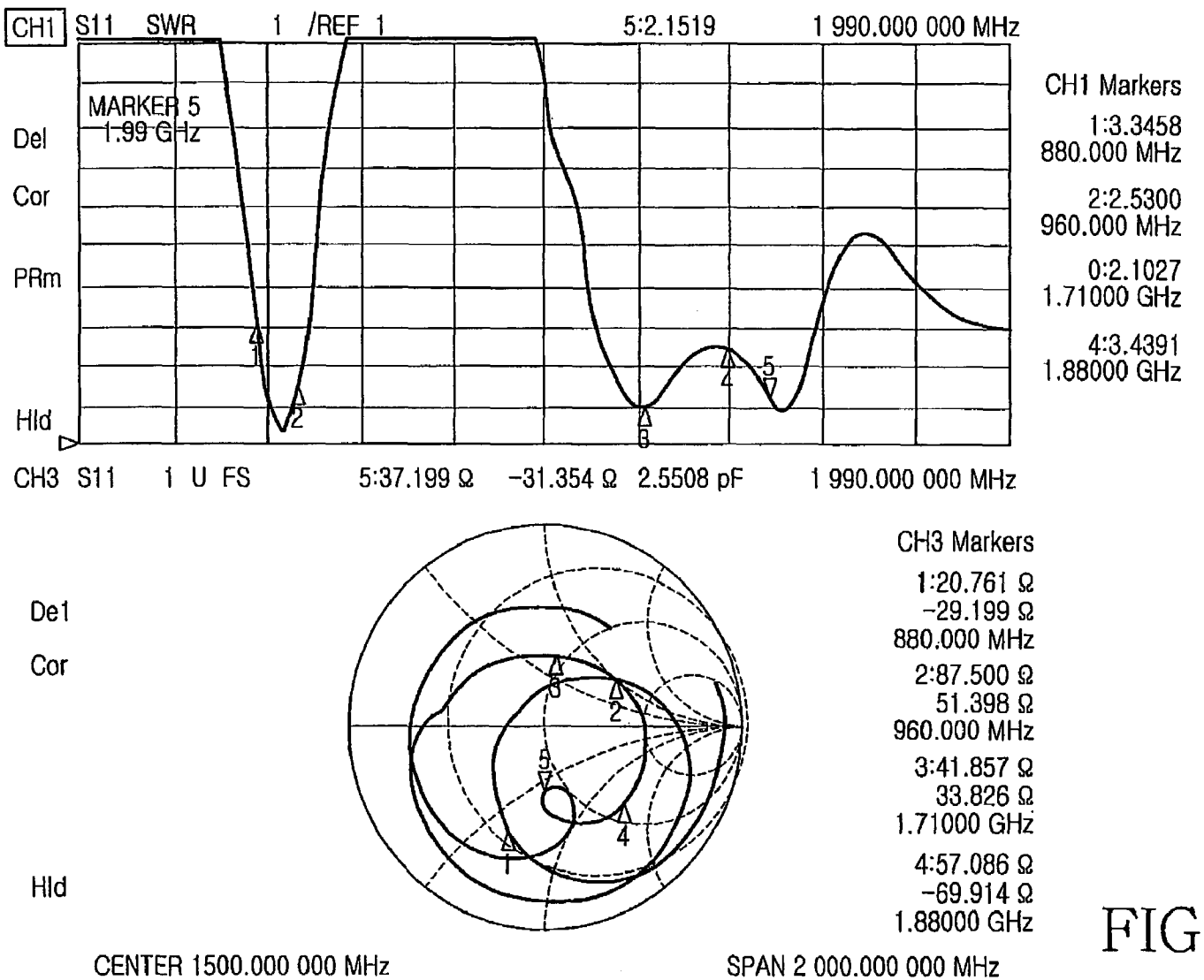
FIGS. 5A and 5B are charts illustrating Voltage Standing Wave Ratio (VSWR) measurement results when a slide type terminal having a built-in antenna module is slid up and down according to the present invention.
Figure 5B:
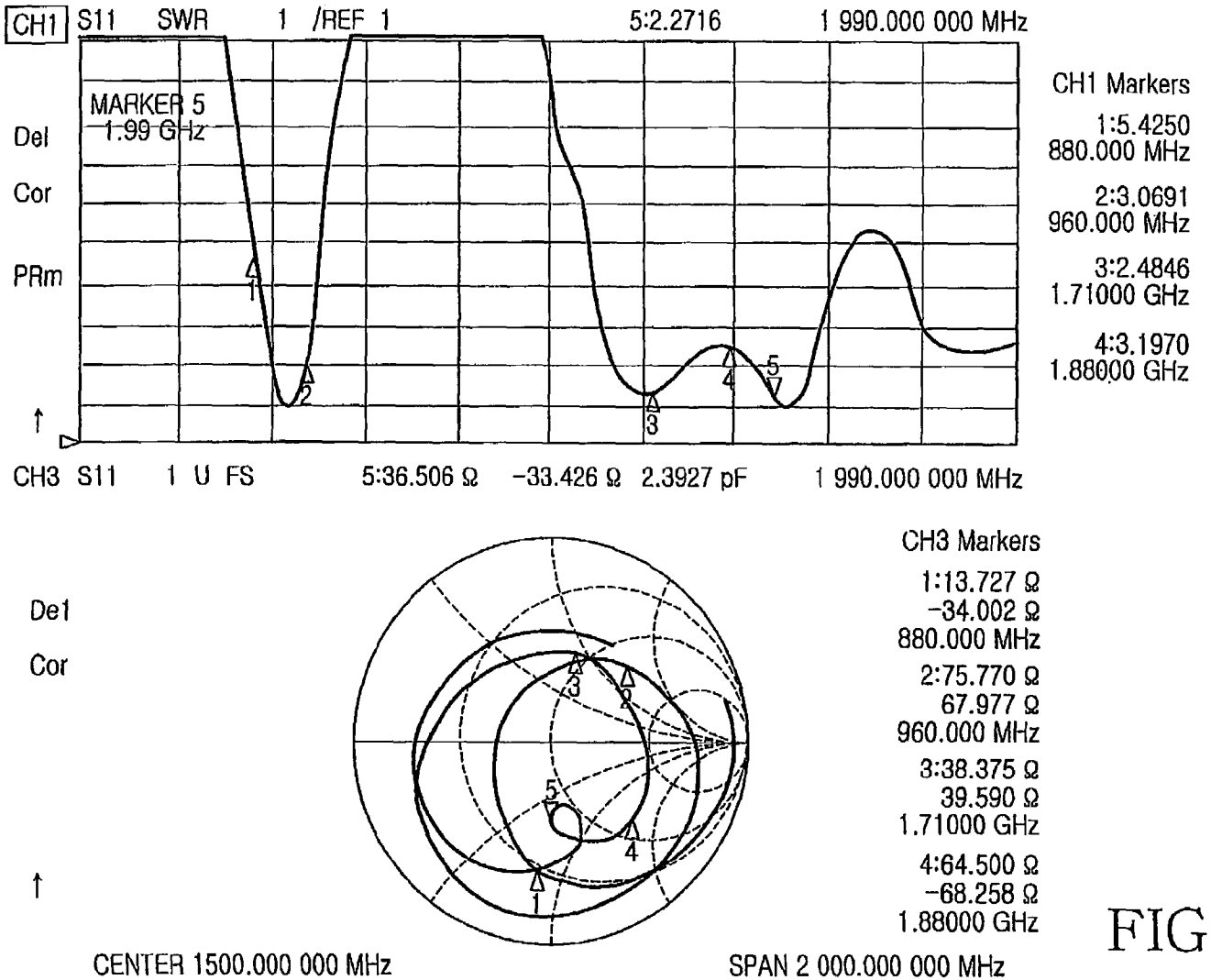

FIGS. 5A and 5B are charts illustrating Voltage Standing Wave Ratio (VSWR) measurement results when a slide type terminal with a built-in antenna module is slid up and down according to the present invention. The antenna is designed to have an optimized characteristic in a slide-up state, which is actually a busy state. Since a slide-down state is almost in a reception standby, a somewhat high numerical value of the VSWR (marker 1 and marker 3 in FIGS. 5A and 5B) does not have much influence on a performance of the terminal when the transmission is performed. Actually, it is impossible to design the terminal to concurrently satisfy all performance goals for the terminal when the terminal is in either the slide-up state or the slide-down state. The slide-up state and the slide-down state have a relation of mutual trade-off. Therefore, a transmission characteristic of the slide-down state, which has less influence on the performance of the terminal, is sacrificed.

The below Tables 1 and 2 show SARs when the built-in antenna module is applied to a Global System for Mobile (GSM) and when the built-in antenna module is applied to a Digital Cellular System (DCS) according to the present invention.

TABLE 1

| Mode | Power | Head | Position | Slide type | CH. | 10 g SAR (W/kg) |
|---|---|---|---|---|---|---|
| EGSM | 33 dBm | Left | Cheek | Up | 975 | 0.220 |
| | | | Cheek | Down | 975 | 0.115 |
| | | | Cheek | Up | 37 | 0.409 |
| | | | Cheek | Down | 37 | 0.317 |
| | | | Cheek | Up | 124 | 0.443 |
| | | | Cheek | Down | 124 | 0.383 |
| | | | Tilt | Up | 37 | 0.177 |
| | | | Tilt | Down | 37 | 0.156 |
| | | | Cheek | Up | 975 | 0.230 |
| 900 | | Right | Cheek | Down | 975 | 0.126 |
| | | | Cheek | Up | 37 | 0.397 |
| | | | Cheek | Down | 37 | 0.265 |
| | | | Cheek | Up | 124 | 0.470 |
| | | | Cheek | Down | 124 | 0.404 |
| | | | Tilt | Up | 37 | 0.169 |
| | | | Tilt | Down | 37 | 0.168 |

TABLE 2

| Mode | Power | Head | Position | Slide type | CH. | 10 g SAR (W/kg) |
|---|---|---|---|---|---|---|
| DSC 1800 | 30 dBm | Left | Cheek | Up | 512 | 0.104 |
| | | | Cheek | Down | 512 | 0.115 |
| | | | Cheek | Up | 700 | 0.101 |
| | | | Cheek | Down | 700 | 0.129 |
| | | | Cheek | Up | 885 | 0.095 |
| | | | Cheek | Down | 885 | 0.135 |
| | | | Tilt | Up | 700 | 0.061 |
| | | | Tilt | Down | 700 | 0.068 |
| | | Right | Cheek | Up | 512 | 0.106 |
| | | | Cheek | Down | 512 | 0.115 |
| | | | Cheek | Up | 700 | 0.086 |
| | | | Cheek | Down | 700 | 0.108 |
| | | | Cheek | Up | 885 | 0.100 |
| | | | Cheek | Down | 885 | 0.122 |
| | | | Tilt | Up | 700 | 0.067 |
| | | | Tilt | Down | 700 | 0.047 |

As shown in the Tables 1 and 2, in the GSM, the SAR is measured as being less than 0.47 W/kg to the maximum, and in the DSC, the SAR is measured as being less than 0.135 W/kg at maximum. It can be appreciated that the above measurement results are excellent, at least considering that a European standard for 10 g SAR is less, on average, than 2.0 W/kg. Considering that a recent characteristic of SAR is being very emphasized and strict regulation is required worldwide, the above measurement results are satisfactory, and can be referred when a similar terminal is developed later.

The inventive plate type built-in antenna module improves performance by disposing the ground plate between the radiator and the ground surface, such that the radiator and the ground surface are spaced apart from each other at a maximum distance to provide an excellent radiation characteristic in comparison to the conventional built-in antenna and also provide the SAR on the basis of a worldwide standard, thereby more improving the antenna performance of the terminal.

The forgoing embodiments are merely exemplary and are not to be construed as limiting the present invention. The present teachings can be readily applied to other types of apparatus. The description of the present invention is intended to be illustrative, and not to limit the scope of the claims. Many alternatives, modifications, and variations will be apparent to those skilled in the art.

What is claimed is:

1. A built-in antenna module for a portable wireless terminal, the module comprising:

a mainboard being an RF board and having a feeding unit, a grounding unit, an upper surface, a lower surface opposite the upper surface, and a thickness t1;

a radiator disposed on one side facing the upper surface of the mainboard, and having a feed pin and a ground pin electrically connected to the feeding unit and the grounding unit of the mainboard, respectively;

a conductive layer electrically connected to the ground unit and disposed on the lower surface to add an amount up to t1 to an orthogonal distance between the radiator and the conductive layer for improving antenna performance; and a conductive ground plate disposed on the other side facing the lower surface of the mainboard and spaced a predetermined height therefrom for improving antenna performance, the conductive ground plate being electrically connected to the radiator via the ground unit and the ground pin.

2. The module of claim 1, wherein the ground plate is used as a ground together with the conductive layer.

3. The module of claim 2, wherein the conductive layer is electrically connected with the end of the ground plate.

4. The module of claim 3, wherein the conductive layer is not formed on a portion of the mainboard on where the ground plate is orthogonally projected.

5. The module of claim 4, wherein a plurality of nonconductive spacers are interposed between the mainboard and the ground plate so that a distance between the mainboard and the ground plate is not arbitrarily reduced.

6. The module of claim 1, wherein the ground plate is fixed to the mainboard by a solder.

7. The module of claim 1, wherein the ground plate is fixed to the mainboard by a plurality of screws.

* * * * *